US010139760B2

(12) United States Patent
Mukoyama et al.

(10) Patent No.: US 10,139,760 B2
(45) Date of Patent: Nov. 27, 2018

(54) FIXING BELT, FIXING DEVICE, AND IMAGE FORMING APPARATUS

(71) Applicant: Konica Minolta, Inc., Tokyo (JP)

(72) Inventors: Izumi Mukoyama, Tokyo (JP); Naoko Uemura, Tokyo (JP); Asao Matsushima, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/934,323

(22) Filed: Mar. 23, 2018

(65) Prior Publication Data

US 2018/0284665 A1 Oct. 4, 2018

(30) Foreign Application Priority Data

Mar. 30, 2017 (JP) ..... 2017-067573

(51) Int. Cl.

*G03G 15/20* (2006.01)
*G03G 15/16* (2006.01)
*G03G 15/00* (2006.01)

(52) U.S. Cl.

CPC ..... *G03G 15/2057* (2013.01); *G03G 15/16* (2013.01); *G03G 15/2025* (2013.01); *G03G 15/2039* (2013.01); *G03G 15/757* (2013.01); *G03G 2215/2032* (2013.01)

(58) Field of Classification Search

USPC ..... 399/107, 110, 122, 320, 328, 329; 219/216, 619

See application file for complete search history.

(56) References Cited

U.S. PATENT DOCUMENTS 6,363,229 B1 * 3/2002 Shiraishi ..... G03G 15/2064 219/216
7,310,492 B2 * 12/2007 Kimura ..... G03G 15/2025 399/12
7,488,528 B2 * 2/2009 Iwamoto ..... B32B 7/06 399/333
8,195,077 B2 * 6/2012 Moteki ..... G03G 15/6585 399/341

FOREIGN PATENT DOCUMENTS

JP 2012108545 A 6/2012

* cited by examiner

*Primary Examiner* — Hoan Tran
(74) *Attorney, Agent, or Firm* — Lucas & Mercanti, LLP

(57) ABSTRACT

Provided is a fixing belt including a base layer, an elastic layer, and a release layer. The release layer has surface geometry including a first uneven profile and a second uneven profile formed on the surface of the first uneven profile. The first uneven profile is represented as a maximum height roughness, Rz, of 5.0 to 100 μm. The second uneven profile is represented as Rz of 0.5 to 0.9 μm.

6 Claims, 2 Drawing Sheets

FIXING BELT, FIXING DEVICE, AND IMAGE FORMING APPARATUS

CROSS REFERENCE TO RELATED APPLICATIONS

Japanese Patent Application No. 2017-067573 filed on Mar. 30, 2017, including description, claims, drawings, and abstract the entire disclosure is incorporated herein by reference in its entirety.

BACKGROUND

Technological Field

The present invention relates to a fixing belt, a fixing device, and an image forming apparatus.

Description of Related Art

A fixing device employed for image forming apparatuses including copiers and laser beam printers generally brings a heated fixing belt into contact with a recording medium bearing an unfixed toner image thereon to fix the toner image onto the recording medium. In the fixing device, for example, one of two or more rollers supporting a fixing belt in an endless state is a heat roller that heats the fixing belt. The fixing device has excellent fixability by virtue of the relatively small heat capacity of the fixing belt, and the excellent fixability is advantageous, for example, for achievement of higher speed in formation of an image.

A technique for the fixing device is known, in which the fixing device includes a fixing belt with a trilayer structure including a base material, an elastic layer, and a surface layer, a larger curvature is imparted to the exit side of a nip portion formed by an upper pressure roller and the fixing belt (downstream side in a conveyance direction for a recording medium), and the surface properties of the fixing belt are improved by using fluororesin such as PFA for the material of the surface layer (e.g., Japanese Patent Application Laid-Open No. 2012-108545).

Further, the image forming apparatus is generally required to operate in high speed, and for the purpose it is effective to set the curvature of the fixing belt small at the nip portion, for example, set the diameter of a roller hanging the fixing belt thereon large, the roller provided at a position opposite to the pressure roller. However, a larger roller diameter leads to a smaller curvature in the exit side, and thus it is generally difficult to achieve higher speed (upsizing) in formation of an image and increase of the curvature in combination, and they are in trade-off relation.

It is preferred that the material of the surface layer be fluororesin, from the viewpoint of releasability. Modification of the surface properties of the surface layer, for example, enhancement of the releasability, generally depends on how many fluorine atoms (F groups) can be disposed on the surface of the surface layer, and this result determines the non-tackiness (high contact angle, low surface energy) of the surface layer. However, the surface layer made of fluororesin suffers from high tendency of the fluorine atoms to localize on the surface, with little room left for introduction of an F group or another substituent as an alternative to an F group on the surface. Accordingly, it is difficult to enhance the non-tackiness through modification of PFA. Thus, further study is needed to achieve separability and fixability in combination in a fixing belt including a surface layer made of fluororesin to meet the current requirement for higher speed in formation of an image.

SUMMARY

An object of the present invention is to provide a technique for fixation of a toner image in electrophotographic image formation, the technique capable of achieving excellent fixation of a toner image in combination with excellent separation of a recording medium even in high-speed image formation.

The present inventors found that a particular uneven profile imparted to the surface of a surface layer (hereinafter, also referred to as "release layer") enhances the non-tackiness of the surface layer, and completed the present invention.

In order to realize at least one of the above-mentioned objects, a fixing belt reflecting an aspect of the present invention includes a base layer made of heat-resistant resin, an elastic layer made of an elastic material and disposed on the base layer, and a release layer made of fluororesin and disposed on the elastic layer, in which the release layer has surface geometry including a first uneven profile and a second uneven profile formed on the surface of the first uneven profile, the first uneven profile is represented as a maximum height roughness of 5.0 to 100 μm, and the second uneven profile is represented as a maximum height roughness of 0.5 to 0.9 μm.

In order to realize at least one of the above-mentioned objects, a fixing device reflecting an aspect of the present invention includes: a fixing belt in an endless state; two or more rollers that support the fixing belt in an endless state; a heater that heats the fixing belt supported by the rollers; and a pressure roller disposed to be relatively biased against one of the two or more rollers, in which the roller to be biased by the pressure roller via the fixing belt has a roller diameter of 50 mm or larger.

In order to realize at least one of the above-mentioned objects, an electrophotographic image forming apparatus reflecting an aspect of the present invention includes a fixing device that fixes an unfixed toner image borne on a recording medium onto the recording medium through heating and pressing.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
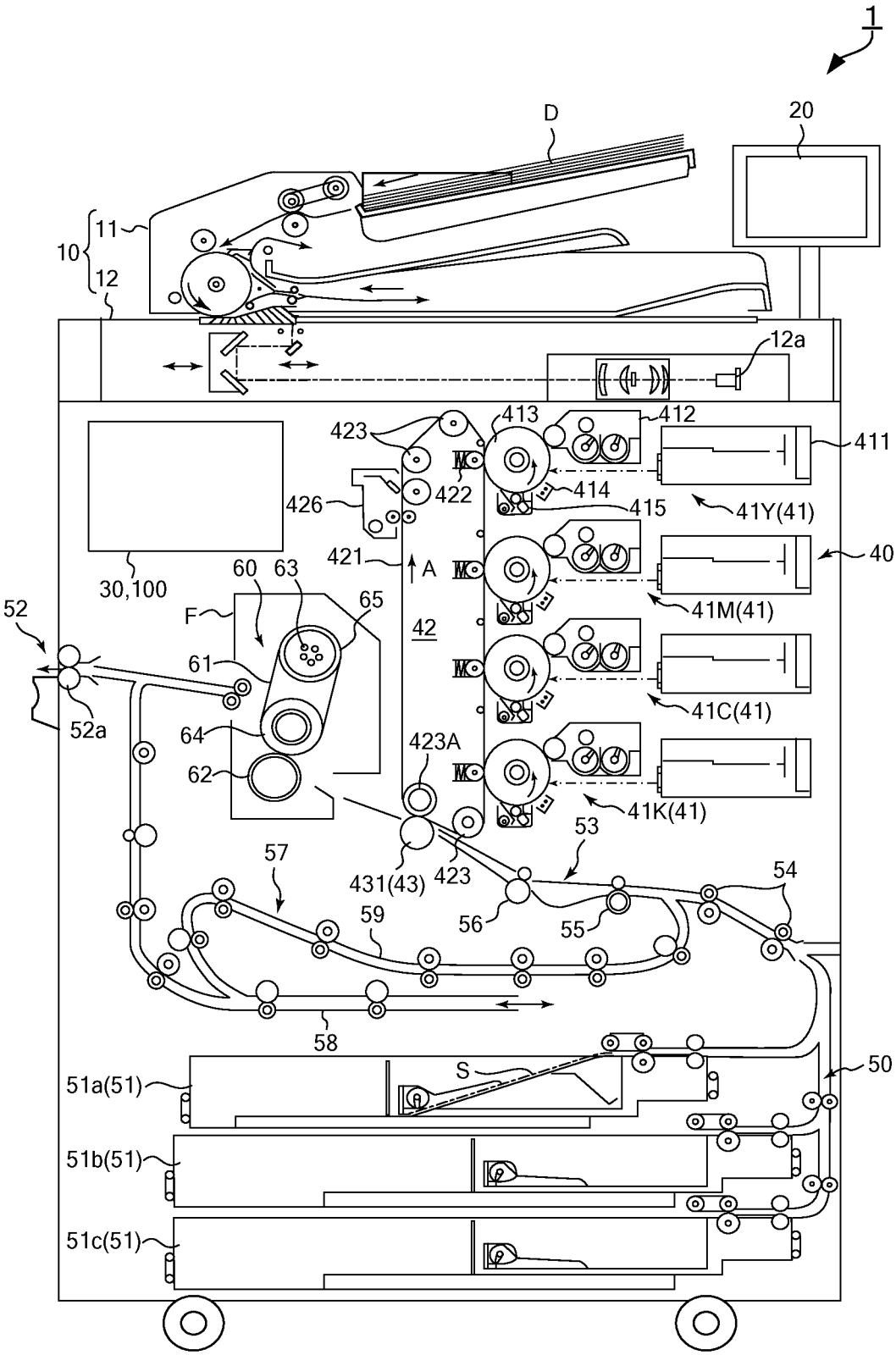
FIG. 1 is a diagram schematically illustrates the configuration of an image forming apparatus according to one embodiment of the present invention.

Hereinafter, one or more embodiments of the present invention will be described with reference to the drawings. However, the scope of the invention is not limited to the disclosed embodiments.

Now, an embodiment of the present invention will be described. The fixing belt according to the present embodiment includes a base layer made of heat-resistant resin, an elastic layer made of an elastic material and disposed on the base layer, and a release layer made of fluororesin and disposed on the elastic layer. The fixing belt can be configured in the same manner as known fixing belts including a base layer, an elastic layer, and a release layer stacked in the order presented, except that the release layer has particular surface geometry as described later.

The base layer is made of heat-resistant resin. The phrase "made of heat-resistant resin" means that the main material constituting the base layer is heat-resistant resin, and the term "heat-resistant" means that the resin is sufficiently stable and exhibits expected physical properties at the temperature at which the fixing belt is used for fixing a toner image onto a recording medium in electrophotographic image formation (e.g., 150 to 220° C.).

The heat-resistant resin can be appropriately selected from resins which undergo substantially no denaturation or deformation at the above working temperature for the fixing belt, and one or more heat-resistant resins may be used. Examples of the heat-resistant resin include polyphenylene sulfide, polyarylate, polysulfone, polyethersulfone, polyetherimide, polyimide, polyamideimide, and polyether ether ketone. Among them, polyimide is preferred from the viewpoint of heat resistance.

Polyimide can be obtained through progression of dehydration and cyclization (imidization) reaction of polyamic acid as a precursor of polyimide by heating at 200° C. or higher or by using a catalyst. Polyamic acid may be produced in a manner such that tetracarboxylic dianhydride and a diamine compound are dissolved in a solvent and mixed together and heated for polycondensation reaction, or a commercially available product of polyamic acid may be used. Examples of the diamine compound and tetracarboxylic dianhydride include compounds described in paragraphs [0123] to [0130] of Japanese Patent Application Laid-Open No. 2013-25120.

The content of the heat-resistant resin in the base layer may be any content sufficient for formation of the base layer, and, for example, the content is preferably 50 mass % or more, more preferably 60 to 75 mass %, and even more preferably 76 to 90 mass %.

The base layer may further contain a component other than the heat-resistant resin in a manner such that the advantageous effects of the present embodiment are obtained. For example, the base layer may contain a filler. The filler is a component, for example, that contributes to enhancement of at least any of the hardness, thermal conductivity, and electroconductivity of the base layer. One or more fillers may be used, and examples of the filler include carbon black, Ketjen black, nanocarbon, and graphite.

If the content of the filler in the base layer is excessively high, the toughness of the base layer is lower and the fixability and separability of the fixing belt may be lowered, and if the content is excessively low, effects expected for the filler to exert, such as addition of moderate electroconductivity, may be insufficient. From these viewpoints, the content of the filler in the base layer is preferably 3 mass % or more, more preferably 4 mass % or more, and even more preferably 5 mass % or more. In addition, from the above viewpoints, the content of the filler in the base layer is preferably 30 mass % or less, more preferably 20 mass % or less, and even more preferably 10 mass % or less.

The elastic layer is a layer having elasticity that contributes to enhancement of contact between the surface of the fixing belt and a recording medium bearing an unfixed toner image at a fixing nip portion, and is made of an elastic material. The phrase "made of an elastic material" means that the main material constituting the elastic layer is an elastic material, and the term "elastic" means that the material allows deformation to the fixing belt so that the surface of a recording medium bearing an unfixed toner image thereon sufficiently comes into contact with the fixing belt in fixing a toner image onto a recording medium through electrophotographic image formation.

One or more elastic materials may be used, and the elastic material is, for example, a material having a loss tangent (ratio of loss elastic modulus to storage elastic modulus), tan δ, of 0.1 or lower at 20 Hz. Examples of the elastic material include elastic resin materials, and examples thereof include silicone rubber, thermoplastic elastomer, and rubber materials. Especially, it is preferred that the elastic material be silicone rubber, from the viewpoint of heat resistance in addition to expected elasticity.

One or more silicone rubbers may be used. Examples of the silicone rubber include polyorganosiloxane or a heat-cured product thereof, and addition reaction-type silicone rubber described in Japanese Patent Application Laid-Open No. 2009-122317. Examples of the polyorganosiloxane include dimethylpolysiloxane in which a vinyl group is present as a side chain and each end is capped with a trimethylsiloxane group, the dimethylpolysiloxane described in Japanese Patent Application Laid-Open No. 2008-255283.

The thickness of the elastic layer is preferably 5 to 300 μm, more preferably 50 to 250 μm, and even more preferably 100 to 200 μm, from the viewpoint of, for example, sufficient development of thermal conductivity and elasticity.

The elastic layer may further contain a component other than the elastic resin material in a manner such that the advantageous effects of the present embodiment are obtained. For example, the elastic material may further contain a thermal-conductive filler that increases the thermal conductivity of the elastic layer. Examples of the material of the filler include silica, metal silica, alumina, zinc, aluminum nitride, boron nitride, silicon nitride, silicon carbide, carbon, and graphite. The form of the filler is not limited, and examples thereof include spherical powder, irregular-shaped powder, flat powder, and fibers.

The content of the elastic resin material as the elastic material is preferably 60 to 100 vol %, more preferably 75 to 100 vol %, and even more preferably 80 to 100 vol %, from the viewpoint of, for example, achievement of thermal conductivity and elasticity in combination.

The release layer is a layer, for example, having releasability that contributes to enhancement of the separability of the surface of the fixing belt from a melt toner layer on a recording medium at the fixing nip portion, and has moderate releasability for toner components. The release layer constitutes the outer surface of the fixing belt in contact with a recording medium in fixation. The release layer is made of fluororesin. The phrase "made of fluororesin" means that the main material constituting the release layer is fluororesin.

Examples of the fluororesin include perfluoroalkoxy fluororesin (PFA), tetrafluoroethylene-hexafluoropropylene copolymer (FEP), and tetrafluoroethylene-ethylene copolymer (ETFE).

The thickness of the release layer is preferably 5 to 40 μm, more preferably 10 to 35 μm, and even more preferably 20 to 30 μm, from the viewpoint of, for example, transmission of heat, following to the deformation of the elastic layer, and development of releasability.

The release layer may further contain an additional component other than the fluororesin in a manner such that the advantageous effects of the present embodiment are obtained. For example, the release layer may further contain a lubricant particle. Examples of the lubricant particle include fluororesin particles, silicone resin particles, and silica particles.

The content of the fluororesin as the material of the release layer is preferably 70 to 100 vol % from the viewpoint of thermal conductivity and flexibility to sufficiently follow to the deformation of the elastic layer.

The release layer has surface geometry including a first uneven profile and a second uneven profile formed on the surface of the first uneven profile. In this way, the release layer has periodic large roughness as the first uneven profile, and small roughness therein as the second uneven profile. The fixing belt has a role to convey a recording medium such as a paper sheet, fix a toner image onto the paper sheet, and separate the fixed toner image from the fixing belt. The first uneven profile with periodic large roughness facilitates inclusion of air between the fixing belt and a toner image, and thus larger releasing effect is provided. Such an effect by the first uneven profile is exerted especially at the exit of the nip portion.

The first uneven profile is represented as a maximum height roughness of 5.0 to 100 μm. If the first uneven profile is excessively small, inclusion of air between the fixing belt and a toner image is insufficient, and as a result the contact area between the fixing belt and a toner image becomes larger and separation failure of a toner image (recording medium bearing it) is likely to occur. If the first uneven profile is excessively large, in contrast, inclusion of air between the fixing belt and a toner image is excessive, and as a result the contact area between the fixing belt and a toner image becomes smaller and fixing failure is likely to occur.

The first uneven profile is preferably represented as a maximum height roughness of 10 μm or larger from the viewpoint of enhancement of separability, and more preferably represented as a maximum height roughness of 30 μm or larger. From the viewpoint of enhancement of fixability, the first uneven profile is preferably represented as a maximum height roughness of 55 μm or smaller.

The second uneven profile is formed in the first uneven profile having periodic large roughness, and has small roughness. The second uneven profile facilitates inclusion of air between the fixing belt and a toner image.

The second uneven profile is represented as a maximum height roughness of 0.5 to 0.9 μm. If the second uneven profile is excessively large or excessive small, the effect to include air between the fixing belt and a toner image may be insufficient, leading to insufficient separability. If the surface geometry of the release layer consists only of the first uneven profile, less air is included between the fixing belt and a toner image. If the surface geometry of the release layer consists only of the second uneven profile, inclusion of air between the fixing belt and a toner image is insufficient, which leads to insufficient separability (small releasing effect).

The maximum height roughness, Rz, representing the first or second uneven profile is the sum of the maximum value of ridge heights and the maximum value of trough depths in a roughness curve within a reference length (λc), and measured in accordance with JIS B0601 (2001). Specifically, Rz is the sum of the maximum value of ridge heights (Zp), Rp, and the maximum value of trough depths (Zv), Rv, in a profile curve within a reference length (Rz=Rp+Rv).

The surface roughness, Rz, representing the first or second uneven profile can be measured by using the surface roughness meter "SURFCOM 1400D" (manufactured by TOKYO SEIMITSU CO., LTD., "SURFCOM" is a registered trademark possessed by the company) with a cut-off value of 1 μm, an evaluation length, L, of 8 mm, and a measurement speed of 0.06 mm/sec, and is represented as the mean of values of Rz, for example, measured at 100 arbitrarily selected measurement positions. Rz representing the first uneven profile can be determined through measurement according to the above measurement method with exclusion of unevenness equal to or smaller than a cut-off value of 0.1 μm, and Rz representing the second uneven profile can be determined through measurement with exclusion of unevenness equal to or larger than a cut-off value of 0.1 μm.

The first and second uneven profiles can be appropriately formed on the surface of the release layer in accordance with a known method for roughening the surface of a resin coating film. Although the first and second uneven profiles can be formed in accordance with a known method such as transfer of unevenness, it is preferred to form them through blasting, from the viewpoint of achievement of a desired surface roughness regardless of the method for producing the release layer. To form each of the first and second uneven profiles through blasting in a suitable manner, blasting for formation of the first uneven profile is performed, and blasting for formation of the second uneven profile is then performed.

In the case that the first or second uneven profile is formed through blasting, the ratio between roughness and period in the first or second uneven profile is preferably approximately 1 (e.g., 0.8 to 1.2), from the viewpoint of prevention of formation of a through-hole in the release layer through blasting. The ratio can be achieved, for example, by using spherical glass beads.

The fixing belt can be produced by using a method including forming the first uneven profile on the surface of a fixing belt including a base layer, an elastic layer, and a release layer in the order presented, and forming the second uneven profile on the surface of the release layer having the first uneven profile.

The formation of the first uneven profile can be achieved through blasting as described above, or through a known method such as a method of transferring unevenness onto the surface of the release layer, a method of generating and growing crystals of fluororesin in the release layer, and a method of mechanically polishing the surface of the release layer.

The formation of the second uneven profile can be achieved through a known method capable of forming second unevenness on the surface geometry represented as Rz, i.e., the first uneven profile, in the surface of the release layer, and blasting is preferably performed for the formation of the second uneven profile, from the viewpoint of formation of unevenness with a desired scale on the whole surface of the first uneven profile.

In the case that the first and second uneven profiles are formed through blasting, the scale of each of them can be appropriately adjusted through conditions including the type and size of a projection material, and the pressure, distance, and angle in projection.

The method for producing the fixing belt may further include an additional step other than the formation of the uneven profiles, and examples of the additional step include producing a base layer, producing an elastic layer on a base layer, and producing on an elastic layer a layer made of a material of a release layer without any of the first and second uneven profiles. Each of these additional steps can be performed by using a known method capable of producing these layers. For example, the base layer can be produced through molding or curing of a material composition containing the above heat-resistant resin or a precursor thereof and the above filler.

The fixing belt is applied to a fixing device in an electrophotographic image forming apparatus. The image forming apparatus including the fixing belt can be configured in the same manner as a known image forming apparatus including a fixing device that fixes an unfixed toner image on a recording medium onto the recording medium through heating and pressing with a fixing belt, except that the image forming apparatus includes the above fixing belt. The fixing belt can be used for high-speed electrophotographic image formation, and also for formation of an image at lower speed. The term "high-speed" in high-speed image formation refers, for example, to a printing speed of 60 sheets/min or higher with A4 recording media, more specifically, can refer to a printing speed of 60 to 80 sheets/min with A4 recording media.

The fixing device includes a fixing belt in an endless state; two or more rollers that support the fixing belt in an endless state; a heater that heats the fixing belt supported by the rollers; and a pressure roller disposed to be relatively biased against one of the two or more rollers. The fixing device can be configured in the same manner as a known, what is called, twin-shaft belt fixing device, except that the fixing device includes the fixing belt according to the present embodiment as the fixing belt in an endless state.

At least one of the two or more rollers may incorporate the heater therein, and, for example, a heat roller that heats the fixing belt may be included. The heat roller includes, for example, a thermal-conductive sleeve made of aluminum or the like, and a heat source such as a halogen heater to be disposed in the inside of the sleeve. The outer peripheral surface of the sleeve may be covered with a layer made of fluororesin such as polytetrafluoroethylene (PTFE).

The heater may be a heater to be disposed out of the rollers, in other words, a heater to be disposed in the inner periphery side or outer periphery side of an endless track formed by the fixing belt under support so that the heater faces the endless track, or both a heater to be incorporated in any of the rollers and a heater to be disposed out of the rollers may be included.

Only one or more of the two or more rollers are required to be not the heat roller, and can be appropriately configured in accordance with other desired functions.

The roller diameter of the roller to be biased by the pressure roller via the fixing belt is preferably large because a large roller diameter allows application to high-speed image formation, and the roller diameter is, for example, 50 mm or larger. If the roller diameter is large, a recording medium tends to be poorly separated from the fixing belt at the fixing nip portion in fixation to resulting in difficulty in the separation in high-speed image formation. In the above fixing device, the roller diameter can be appropriately set for excellent separability and fixability in the fixing belt and desired image formation speed. For example, the roller diameter is preferably 60 mm or larger from the viewpoint of achievement of higher speed in formation of an image, and enhancement of the fixability of the fixing belt for a recording medium in fixation.

The fixing belt is supported by the two or more rollers in a tensioned state, in other words, with a certain tension applied thereto. If the tension is excessively large, physical properties that contribute to the adhesion of the fixing belt to a recording medium, including the elasticity of the elastic layer, may insufficiently develop at the fixing nip portion. From the viewpoint of such adhesion, the tension is preferably 45 N or lower, and more preferably 50 N or lower. The tension may be at any level enough to maintain the shape of an endless track formed by the fixing belt supported by the rollers, and is suitably 20 N or higher, for example. The tension can be adjusted via the distances among the two or more rollers.

The image forming apparatus including the fixing belt can be configured in the same manner as a known image forming apparatus including a fixing device that fixes an unfixed toner image on a recording medium onto the recording medium through heating and pressing with a fixing belt, except that the image forming apparatus includes the above fixing belt.

Now, an embodiment of the present invention will be described in more detail with reference to the accompanying drawings.

As illustrated in FIG. 1, image forming apparatus 1 includes image reading section 10, operation display section 20, image processing section 30, image forming section 40, sheet conveyance section 50, fixing section 60, and controlling section 100.

Controlling section 100 is a device that controls operations of blocks in image forming apparatus 1 in a centralized manner in cooperation with a program decompressed, and includes, for example, a CPU (Central Processing Unit), a ROM (Read Only Memory), and a RAM (Random Access Memory).

Image reading section 10 is configured with automated original document feeding device 11 called ADF (Auto Document Feeder), original image scanning device 12 (scanner), and so on. Operation display section 20 is configured, for example, with a liquid crystal display (LCD) with a touch panel, and functions as a display section and an operation section. Image processing section 30 includes a circuit that performs digital image processing for input image data in accordance with default settings or user's settings.

Image forming section 40 includes image forming unit 41 that forms an image with colored toners as a Y component, M component, C component, and K component on the basis of input image data, intermediate transfer unit 42, secondary transfer unit 43, and so on.

Image forming unit 41 is configured with four image forming units 41Y, 41M, 41C, and 41K for the Y component, M component, C component, and K component, respectively. Since image forming units 41Y, 41M, 41C, and 41K each have an identical configuration, components common to them are indicated by an identical reference sign, and Y, M, C, or K is added when they are to be discriminated from each other, for convenience of illustration and description. In FIG. 1, reference signs are assigned only to components of image forming unit 41Y for the Y component, and reference signs for components of other image forming units 41M, 41C, and 41K are omitted.

Image forming unit 41 includes exposing device 411, developing device 412, photoconductor drum 413, charging device 414, drum cleaning device 415, and so on.

Photoconductor drum 413 is a negatively-chargeable organic photoconductor (OPC) including, for example, an aluminum electroconductive cylinder (aluminum element tube) on the peripheral surface of which an under coat layer (UCL), a charge generation layer (CGL), and a charge transport layer (CU) are sequentially laminated.

Charging device 414 is a non-contact charging device, for example, using corona discharging. Charging device 414 may be a contact charging device that comes into contact with photoconductor drum 413 to charge it. Exposing device 411 is configured, for example, with a semiconductor laser. Developing device 412 is a developing device for a two-component developer, and contains a developer (e.g., a two-component developer consisting of a toner with a small particle diameter and a magnetic material) for the corresponding color component.

Drum cleaning device 415 includes a drum cleaning blade such as an elastic blade disposed so that the drum cleaning blade can slidingly contact with the surface of photoconductor drum 413.

Intermediate transfer unit 42 includes intermediate transfer belt 421, primary transfer roller 422, a plurality of supporting rollers 423 including backup roller 423A, belt cleaning device 426, and so on.

Intermediate transfer belt 421 is configured with an endless belt, and suspended as a loop on the plurality of supporting rollers 423 in a tensioned state. At least one of the plurality of supporting rollers 423 is configured with a driving roller, and the others are each configured with a driven roller. Belt cleaning device 426 includes a belt cleaning blade such as an elastic blade disposed so that the belt cleaning blade can slidingly contact with the surface of intermediate transfer belt 421.

Secondary transfer unit 43 includes, for example, secondary transfer roller 431. Secondary transfer unit 43 may be configured to be suspended as a loop on a plurality of supporting rollers including secondary transfer roller in a tensioned state.

Fixing section 60 is disposed as a unit in fixing device F. Fixing section 60 includes fixing belt 61 in an endless state; two rollers 64 and 65 that support fixing belt 61 in an endless state; heater 63 that heats fixing belt 61 supported by rollers 64 and 65; and pressure roller 62 disposed to be relatively biased against roller 64.

Roller 64 is disposed opposite to pressure roller 62 via fixing belt 61, and the roller diameter is 50 mm or larger. Rollers 64 and 65 are supporting fixing belt 61 to fit it to an endless track with a tension of 45 N. For example, roller 64 is a driving roller and roller 65 is a driven roller. Heater 63 is configured with a halogen lamp, a resistor heat generator, or the like, and incorporated in roller 65. Pressure roller 62 is disposed in a manner such that pressure roller 62 can freely come close to or depart from roller 64. Pressure roller 62 is pressed against fixing belt 61 supported by roller 64 to form a fixing nip portion that sandwiches and conveys sheet S. Sheet S corresponds to a recording medium, and is, for example, a standard sheet or a special sheet.

A heater using induction heating (IH) may be used for heater 63. An air separation unit that separates sheet S from fixing belt 61 or pressure roller 62 through air-blowing may be further disposed in fixing device F. Fixing section 60 corresponds to the above fixing device.

Figure 2A:
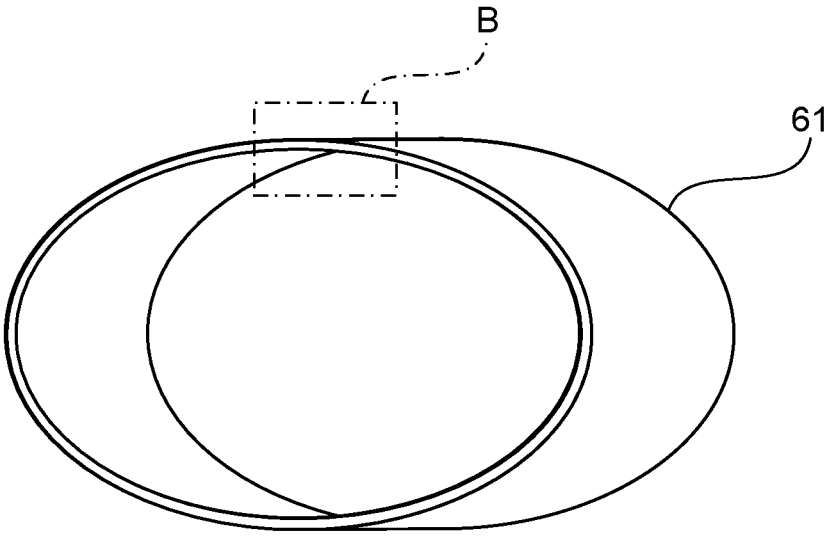
FIG. 2A is a diagram schematically illustrating the configuration of a fixing belt according to one embodiment of the present invention.
Figure 2B:
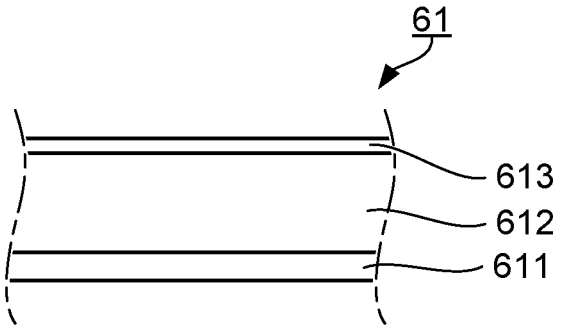
FIG. 2B is an enlarged view of portion B in FIG. 2A.

Fixing belt 61 is a belt in an endless state as illustrated in FIG. 2A, and configured to include base layer 611, elastic layer 612, and release layer 613 stacked in the order presented as illustrated in FIG. 2B. Base layer 611 is a belt made of polyimide, and carbon black is dispersed in base layer 611. Elastic layer 612 is a layer made of, for example, silicone rubber with elasticity, and release layer 613 is a layer made of, for example, perfluoroalkoxy fluororesin (PFA).

The surface of release layer 613 has surface geometry including a first uneven profile, for example, represented as Rz of 50 μm, and a second uneven profile formed on the surface of the first uneven profile and, for example, represented as Rz of 0.5 μm. In this way, the surface of release layer 613 has relatively large unevenness (undulation) and relatively small unevenness covering the surface of the relatively large unevenness.

Sheet conveyance section 50 includes sheet feeding section 51, sheet ejection section 52, first conveyance section 53, second conveyance section 57, and so on. Three sheet feed tray units 51*a* to 51*c* constituting sheet feeding section 51 each contain sheet S of preset type classified on the basis of the basis weight, size, and so on. First conveyance section 53 includes a plurality of conveyance roller sections including intermediate conveyance roller section 54, loop roller section 55, and registration roller section 56. Second conveyance section 57 includes switchback pathway 58 and back conveyance path 59, in each of which a plurality of conveyance roller sections are disposed.

In image forming apparatus 1, automated original document feeding device 11 conveys original document D placed on an original document tray with the conveyance mechanism to send it to original image scanning device 12. Automated original document feeding device 11 can continuously read images on (both sides of) many sheets of original document D placed on the original document tray in one operation. Original image scanning device 12 optically scans an original document conveyed from automated original document feeding device 11 onto contact glass or an original document placed on the contact glass, and an image is formed with reflected light from the original document onto a light-receiving surface of CCD (Charge Coupled Device) sensor 12*a*, and the original image is read. Image reading section 10 generates input image data on the basis of the reading result obtained by original image scanning device 12. Image processing section 30 performs given image processing for the input image data, as necessary.

Controlling section 100 controls a driving current to be fed to a driving motor (not illustrated) that rotates photoconductor drum 413. Thereby, photoconductor drum 413 rotates at a constant rotation speed. Charging device 414 negatively charges the surface of photoconductor drum 413, which has photoconductivity, uniformly. Exposing device 411 irradiates photoconductor drum 413 with laser light according to the image of the corresponding color component, and an electrostatic latent image of the corresponding color component is formed on the surface of photoconductor drum 413 as a result of a difference in potential from the surrounding area. Developing device 412 visualizes the electrostatic latent image by attaching a toner of the corresponding color component to the surface of photoconductor drum 413 to form a toner image.

At the same time, intermediate transfer belt 421 runs in the direction of arrow A at a constant speed through the rotation of supporting roller 423 as the driving roller. Intermediate transfer belt 421 is pressed against photoconductor drum 413 by primary transfer roller 422 to form a primary transfer nip portion, and the toner images of the respective colors on photoconductor drums 413 are primary-transferred onto intermediate transfer belt 421 in a manner such that the toner images of the respective colors are sequentially stacked. After the primary transfer, untransferred toners remaining on the surface of photoconductor drum 413 are removed from the surface by the elastic blade in contact with the surface of photoconductor drum 413 in drum cleaning device 415.

On the other hand, secondary transfer roller 431 is pressed against backup roller 423A via intermediate transfer belt 421 to form a secondary transfer nip portion. Sheet S fed from sheet feeding section 51 or second conveyance section 57 is conveyed to the secondary transfer nip portion. The inclination and position in the width direction (offset) of sheet S are corrected in the course of conveyance by first conveyance section 53.

When sheet S passes through the secondary transfer nip portion, the toner image borne on intermediate transfer belt 421 is secondary-transferred onto sheet S. Sheet S with the toner image transferred thereonto is conveyed toward fixing section 60. After the secondary transfer, untransferred toners remaining on the surface of intermediate transfer belt 421 are removed from the surface by the elastic blade in contact with the surface of intermediate transfer belt 421 in belt cleaning device 426.

Fixing section 60 fixes the toner image onto sheet S by heating and pressing sheet S conveyed at the fixing nip. Drive control of fixing belt 61, pressure roller 62, heater 63, and so on are performed by controlling section 100.

Fixing belt 61 is heated by heater 63, and as a result the temperature of fixing belt 61 becomes homogeneous over the width direction at a given fixing temperature (e.g., 170° C.). Fixing temperature is temperature enough to supply thermal energy required for melting a toner on sheet S, and depends on the type of sheet S for formation of an image and so on.

In the case of duplex printing, second conveyance section 57 first conveys sheet S to switchback pathway 58, and is then switched back to convey sheet S toward back conveyance path 59, and thereby sheet S is fed to first conveyance section 53 (upstream of loop roller section 55) in a reversed state. Sheet S is again fed to the secondary transfer nip portion and a desired toner image is transferred onto sheet S, and then the toner image is fixed onto sheet S in fixing section 60.

Sheet S with the desired image formed thereon is ejected out of image forming apparatus 1 by sheet ejection section 52 including sheet ejection roller 52*a*.

Fixing belt 61 is excellent in fixability for a toner image onto sheet S and separability from sheet S at the fixing nip portion even in high-speed image formation. The reason is inferred as follows.

Fixing belt 61 is required to have function to convey sheet S, function to fix an unfixed toner image onto sheet S, and function to separate a fixed toner image from fixing belt 61. Fixing belt 61 has periodic large roughness (first uneven profile) in the surface, and has small roughness (second uneven profile) therein. The first uneven profile moderately introduces air between fixing belt 61 and a toner image, and the second uneven profile tends to store the air introduced. As a result, sufficient fixability is exerted while the separation function is sufficiently exerted, especially at the exit of the nip portion, even in high-speed (e.g., 60 to 80 sheets/min for A4 sheets) image formation.

In the case of an image forming method with lower image forming speed, fixing belt 61 sufficiently exerts fixability-enhancing effect due to the above-described trilayer structure and separability-enhancing effect due to the material of the release layer. Thus, image forming apparatus 1 is capable of forming a satisfactory image even in formation of an image in a speed lower than the above-mentioned high speed.

As is clear from the above description, the fixing belt according to the present embodiment includes a base layer made of heat-resistant resin, an elastic layer made of an elastic material and disposed on the base layer, and a release layer made of fluororesin and disposed on the elastic layer, in which the release layer has surface geometry including a first uneven profile and a second uneven profile formed on the surface of the first uneven profile, the first uneven profile is represented as a maximum height roughness of 5.0 to 100 μm, and the second uneven profile is represented as a maximum height roughness of 0.5 to 0.9 μm. The fixing device according to the present embodiment includes a fixing belt in an endless state; two or more rollers that support the fixing belt in an endless state; a heater that heats the fixing belt supported by the rollers; and a pressure roller disposed to be relatively biased against one of the two or more rollers, in which the roller to be biased by the pressure roller via the fixing belt has a roller diameter of 50 mm or larger. Further, the image forming apparatus according to the present embodiment is an electrophotographic image forming apparatus including the fixing device that fixes an unfixed toner image borne on a recording medium onto the recording medium through heating and pressing. Accordingly, the present invention can achieve fixation excellent in both fixation of a toner image and separation of a recording medium in fixing a toner image in electrophotographic image formation, even in the case of high-speed image formation.

The configuration in which the first uneven profile is represented as a maximum height roughness of 10 to 55 μm is even more effective from the viewpoint of enhancement of separability.

The configuration in which the heat-resistant resin is polyimide, the elastic material is silicone rubber, and the fluororesin is perfluoroalkoxy fluororesin is even more effective from the viewpoints of the durability of each member and stability for image fixing and image separability.

The configuration in which the fixing belt is supported by the two or more rollers with a tension of 45 N or lower is even more effective from the viewpoint of enhancement of both the fixability and separability.

EXAMPLES

The present invention will be more specifically described with reference to the following Examples and Comparative Examples. It is to be noted that the present invention is not limited to the following Examples and so on.

Example 1

Varnish containing polyamic acid and 8 mass % of carbon black with respect to the polyamic acid was rotationally applied to the outer surface of a cylindrical mold, and then dried at 300 to 450° C. and imidized, and thus a cylindrical polyimide tube (base material belt) with an inner diameter of 99 mm, a length of 360 mm, and a thickness of 70 μm was produced. The polyamic acid is a polymer derived from dehydration condensation of 3,3',4,4'-biphenyltetracarboxylic dianhydride and p-phenylenediamine.

Subsequently, a cylindrical metal core made of stainless steel with an outer diameter of 99 mm was closely attached to the inside of the base material belt, and the outer side of the base material belt was covered with a cylindrical mold holding a PFA tube with a thickness of 30 μm on the inner peripheral surface, and thus the metal core and the cylindrical mold were coaxially held and a cavity was formed between them. A silicone rubber material was then injected into the cavity and heated for curing, and thus an elastic layer made of the silicone rubber with a thickness of 200 μm was produced.

The rubber hardness (Type A), tensile strength, thermal conductivity, and elongation of the silicone rubber are 30°, 1.5 MPa, 0.7 W/(m·K), and 250%, respectively.

The rubber hardness of the silicone rubber is measured in accordance with JIS K6301 by using a Durometer A with a rubber sheet for measurement with a thickness of 10.0 mm.

The rubber sheet is produced under the same conditions as those for production of the elastic layer.

The tensile strength of the silicone rubber is measured, in the same manner as that of the base material belt, by using a Tensilon universal tensile tester (manufactured by A&D Company, Limited) with the above rubber sheet. The elongation of the silicone rubber is measured by using a Tensilon universal tensile tester (manufactured by A&D Company, Limited) with the above rubber sheet. The thermal conductivity of the silicone rubber is measured by using a QTM quick thermal conductivity meter (manufactured by Kyoto Electronics Manufacturing Co., Ltd.) with the above rubber sheet.

The laminated belt obtained was fixed in a direct pressure manual blasting machine (model FD-5-501, manufactured by Fuji Manufacturing Co., Ltd.) with the PFA layer facing the outside, and generally-spherical glass beads (representative particle diameter: 5 μm) as a projection material (medium) were projected to the PFA layer to form a relatively large first uneven profile over the surface of the PFA layer. Subsequently, the medium was replaced with generally-spherical zirconia beads (representative particle diameter: 0.5 μm), and the surface of the PFA layer was further subjected to blasting to form a relatively small second uneven profile over the whole surface of the PFA layer having the first uneven profile. Thus, fixing belt 1 in an endless shape was obtained, the fixing belt including a base layer made of polyimide, an elastic layer made of silicone rubber, and a release layer made of PFA stacked in the order presented, and having surface geometry including a first uneven profile and a second uneven profile.

Maximum height roughness, Rz, was measured at 100 arbitrarily selected positions in the surface geometry of fixing belt 1 by using the surface roughness meter "SURFCOM 1400D" (manufactured by TOKYO SEIMITSU CO., LTD.) with a cut-off value of 1 μm or smaller or 1 μm or larger, an evaluation length, L, of 8 mm, and a measurement speed of 0.06 mm/sec, and the mean was determined. The mean of Rz as determined with a cut-off value of 1 μm or smaller, Rz (1), was 5.1 μm, and the mean of Rz as determined with a cut-off value of 1 μm or larger, Rz (2), was 0.5 μm.

Examples 2 to 6 and Comparative Examples 1 to 6

Fixing belt 2 was produced in the same manner as in production of fixing belt 1, except that the zirconia beads were replaced with zirconia beads with a representative particle diameter of 0.9 μm. Fixing belt 3 was produced in the same manner as in production of fixing belt 1, except that the glass beads and the zirconia beads were replaced with glass beads with a representative particle diameter of 20 μm and zirconia beads with a representative particle diameter of 0.7 μm, respectively. Rz (1) and Rz (2) of fixing belt 2 were 5.2 μm and 0.9 μm, respectively. Rz (1) and Rz (2) of fixing belt 3 were 17.0 μm and 0.7 μm, respectively.

Fixing belts 4 to 6 were produced in the same manner as production of fixing belt 3, except that the glass beads were replaced with glass beads with a representative particle diameter of 40 μm, 50 μm, and 100 μm, respectively. Rz (1) and Rz (2) of fixing belt 4 were 32.0 μm and 0.7 μm, respectively. Rz (1) and Rz (2) of fixing belt 5 were 55.0 μm and 0.7 μm, respectively. Rz (1) and Rz (2) of fixing belt 6 were 98.3 μm and 0.7 μm, respectively.

Fixing belt C1 was produced in the same manner as in production of fixing belt 2, except that blasting with the zirconia beads was not performed. Fixing belt C2 was produced in the same manner as in production of fixing belt 2, except that blasting with the glass beads was not performed. Rz (1) and Rz (2) of fixing belt C1 were 5.2 μm and 0 μm, respectively. Rz (1) and Rz (2) of fixing belt C2 were 0 μm and 0.9 μm, respectively.

Fixing belt C3 was produced in the same manner as in production of fixing belt 1, except that the glass beads were replaced with glass beads with a representative particle diameter of 4.5 μm. Fixing belt C4 was produced in the same manner as in production of fixing belt C3, except that the zirconia beads were replaced with zirconia beads with a representative particle diameter of 1.2 μm. Rz (1) and Rz (2) of fixing belt C3 were 4.7 μm and 0.4 μm, respectively. Rz (1) and Rz (2) of fixing belt C4 were 4.7 μm and 1.0 μm, respectively.

Further, fixing belts C5 and C6 were produced in the same manner as in production of fixing belts 1 and 2, respectively, except that the glass beads were replaced with glass beads with a representative particle diameter of 150 μm. Rz (1) and Rz (2) of fixing belt C5 were 115.0 μm and 0.5 μm, respectively. Rz (1) and Rz (2) of fixing belt C6 were 113.0 μm and 0.9 μm, respectively.

[Evaluation]

Each of fixing belts 1 to 6 and C1 to C6 was installed as a fixing belt in an electrophotographic image forming apparatus including a twin-shaft belt fixing device as illustrated in FIG. 1. The roller diameter of a roller which constituted a fixing nip portion and was supporting the fixing belt (disposed opposite to a pressure roller) was 60 mm. For each fixing belt, the surface temperature was set at 180° C., and onto A4 sheets of normal paper a toner image (amount of toner attachment: 8 g/m$^2$) as a solid, magenta stripe image having a width of 5 cm and extending in the direction perpendicular to the conveyance direction of the sheets of normal paper, was transferred, and the sheets of normal paper were allowed to pass through the fixing nip portion in the longitudinal direction at a speed of 60 sheets/min, and thus a fixed image of the stripe image was formed on each sheet of normal paper.

(1) Separability

The separability of each fixing belt from the sheet of normal paper in fixing the solid stripe image was determined in accordance with the following criteria.

A: the sheet of normal paper was separated without any curling

B: the sheet of normal paper slightly curled, though the curling was acceptable

C: the sheet of normal paper wrinkled

D: the sheet of normal paper failed to separate (caused paper feed jam)

(2) Fixability

The solid stripe image was visually observed, and the fixability was determined in accordance with the criteria below. "Image defects due to fixing failure" refers to image defects due to cold offset (rough appearance) or image defects due to hot offset (occurrence of paper feed jam).

a: no image defect due to fixing failure was found in the solid image b: slight fixing defects were found, though they were acceptable c: evaluation of the fixability failed because of separation failure d: image defects due to fixing failure were found in the solid image The surface geometry and evaluation results for fixing belts 1 to 6 and C1 to C6 are shown in Table 1. In Table 1, "$r_{M1}$" indicates the representative particle diameter of glass beads, and "$r_{M2}$" indicates the representative particle diameter of zirconia beads.

TABLE 1

| | Fixing belt | | | | | | |
|---|---|---|---|---|---|---|---|
| | | First uneven profile | | Second uneven profile | | | |
| | | $r_{M1}$ | Rz(1) | $r_{M2}$ | Rz(2) | Evaluation | |
| | No. | (μm) | (μm) | (μm) | (μm) | Separability | Fixability |
| Example 1 | 1 | 5 | 5.1 | 0.5 | 0.5 | C | a |
| Example 2 | 2 | 5 | 5.2 | 0.9 | 0.9 | C | a |
| Example 3 | 3 | 20 | 17.0 | 0.7 | 0.7 | B | a |
| Example 4 | 4 | 40 | 32.0 | 0.7 | 0.7 | A | a |
| Example 5 | 5 | 50 | 55.0 | 0.7 | 0.7 | A | a |
| Example 6 | 6 | 100 | 98.3 | 0.7 | 0.7 | A | b |
| Comparative Example 1 | C1 | 5 | 5.2 | — | 0 | D | c |
| Comparative Example 2 | C2 | — | 0 | 0.9 | 0.9 | D | c |
| Comparative Example 3 | C3 | 4.5 | 4.7 | 0.5 | 0.4 | D | c |
| Comparative Example 4 | C4 | 4.5 | 4.7 | 1.2 | 1.0 | D | c |
| Comparative Example 5 | C5 | 150 | 115.0 | 0.5 | 0.5 | A | d |
| Comparative Example 6 | C6 | 150 | 113.0 | 0.9 | 0.9 | A | d |

As is clear from Table 1, any of fixing belts 1 to 6 exhibits sufficient performance in both fixability and separability in a high-speed image forming apparatus with a twin-shaft belt fixing device. In contrast, any of fixing belts C1 to C6 is insufficient in at least one of separability and fixability. It can be seen from these results that the configuration in which a release layer constituting the surface of a fixing belt has surface geometry including both a relatively large first uneven profile and a relatively small second uneven profile formed on the surface of the first uneven profile, the first uneven profile is represented as Rz of 5 to 100 μm, and the second uneven profile is represented as Rz of 0.5 to 0.9 μm enables achievement of the above-mentioned separability and fixability in combination.

As can be seen from fixing belts 3 to 56, the separability is more enhanced when the first uneven profile is set to larger than 5.2 μm and smaller than 17.0 μm, for example, 10 μm or larger, as Rz, and the separability is even more enhanced when the first uneven profile is set to smaller than 32.0 μm, for example, 30 μm or larger, as Rz.

In contrast, any of fixing belts C1 to C4 is insufficient in separability, and for this reason the fixability cannot be evaluated. With respect to fixing belts C1 and C2, this is probably because fixing belt C1 has no second uneven profile, and fixing belt C2 has no first uneven profile, and as a result an air layer is insufficiently formed between a recording medium and the fixing belt in fixation. Each of fixing belts C3 and C4 has an excessively small first uneven profile, which is inferred to cause difficulty in inclusion of air between a recording medium and the fixing belt, and the contact area between the fixing belt and an unfixed toner image becomes larger even in the presence of a second uneven profile, resulting in insufficient separability.

Each of fixing belts C5 and C6 has satisfactory separability, but is insufficient in fixability. This is probably because the excessively large first uneven profile causes excessive inclusion of air between a recording medium and the fixing belt, and the contact between the fixing belt and an unfixed toner image becomes insufficient, resulting in insufficient fixability.

INDUSTRIAL APPLICABILITY

The present invention enables enhancement of both the fixability of a fixing belt and the separability of a fixing belt from a recording medium in electrophotographic image formation by using a high-speed machine with a twin-shaft belt fixing device. Accordingly, the present invention is expected to contribute to achievement of an electrophotographic image forming apparatus with higher speed, higher performance, and lower energy cost, and wider use of the image forming apparatus.

Although embodiments of the present invention have been described and illustrated in detail, the disclosed embodiments are made for purposes of illustration and example only and not limitation. The scope of the present invention should be interpreted by terms of the appended claims.

What is claimed is:

1. A fixing belt comprising a base layer made of heat-resistant resin, an elastic layer made of an elastic material and disposed on the base layer, and a release layer made of fluororesin and disposed on the elastic layer, wherein the release layer has surface geometry including a first uneven profile and a second uneven profile formed on the surface of the first uneven profile, the first uneven profile is represented as a maximum height roughness of 5.0 to 100 μm, and the second uneven profile is represented as a maximum height roughness of 0.5 to 0.9 μm.

2. The fixing belt according to claim 1, wherein the first uneven profile is represented as a maximum height roughness of 10 to 55 μm.

3. The fixing belt according to claim 1, wherein the heat-resistant resin is polyimide, the elastic material is silicone rubber, and the fluororesin is perfluoroalkoxy fluororesin.

4. A fixing device comprising: a fixing belt in an endless state; two or more rollers that support the fixing belt in an endless state; a heater that heats the fixing belt supported by the rollers; and a pressure roller disposed to be relatively biased against one of the two or more rollers, wherein the roller to be biased by the pressure roller via the fixing belt has a roller diameter of 50 mm or larger, and the fixing belt is the fixing belt according to claim 1.

5. The fixing device according to claim 4, wherein the fixing belt is supported by the two or more rollers with a tension of 45 N or lower.

6. An electrophotographic image forming apparatus comprising a fixing device that fixes an unfixed toner image borne on a recording medium onto the recording medium through heating and pressing, wherein the fixing device is the fixing device according to claim 4.

* * * * *